US005185633A

United States Patent [19]

Kawai et al.

[11] Patent Number: 5,185,633

[45] Date of Patent: Feb. 9, 1993

[54] IMAGE FORMING APPARATUS HAVING SINGLE SENSOR FOR DETECTING MISCHUCKING OF TRANSFER PAPER AND WHETHER TRANSFER PAPER IS PLAIN OR TRANSPARENT PAPER

[75] Inventors: Naotoshi Kawai; Kazunobu Maekawa, both of Toyokawa, Japan

[73] Assignee: Minolta Camera Kabushiki Kaisha, Osaka, Japan

[21] Appl. No.: 764,805

[22] Filed: Sep. 24, 1991

[30] Foreign Application Priority Data

Sep. 26, 1990 [JP] Japan ..... 2-257921

[51] Int. Cl.[5] ..... G03G 15/14

[52] U.S. Cl. ..... 355/271; 355/309

[58] Field of Search ..... 355/271, 272, 274, 309, 355/311

[56] References Cited

U.S. PATENT DOCUMENTS 4,819,025 4/1989 Takahashi et al. .
4,851,927 7/1989 Moriya ..... 358/300
4,862,214 8/1989 Kasahara et al. ..... 355/377
4,872,037 10/1989 Kasahara et al. ..... 355/271
4,935,776 6/1990 Fukui ..... 355/274 X

FOREIGN PATENT DOCUMENTS 60-216359 10/1985 Japan .
63-177185 7/1988 Japan .
2-207283 8/1990 Japan .

*Primary Examiner*—Richard L. Moses
*Attorney, Agent, or Firm*—Willian Brinks Olds Hofer Gilson & Lione

[57] ABSTRACT

An image forming apparatus comprising a rotatable transfer drum, chucking member provided at the transfer drum for chucking a transfer paper on the transfer drum and a sensor provided in the vicinity of the transfer drum for detecting the light passing through the transfer drum. In the image forming apparatus, the above single sensor is operable for detecting mischucking of the transfer paper and for detecting whether the transfer paper is a plain paper or OHP paper.

11 Claims, 3 Drawing Sheets

IMAGE FORMING APPARATUS HAVING SINGLE SENSOR FOR DETECTING MISCHUCKING OF TRANSFER PAPER AND WHETHER TRANSFER PAPER IS PLAIN OR TRANSPARENT PAPER

BACKGROUND OF THE INVENTION

1. Field of the Invention

The present invention relates to image forming apparatus such as copying machines and printers, and more particularly to image forming apparatus having means for detecting whether the copy paper to be used is transparent paper for overhead projectors (hereinafter referred to as "OHP paper") or plain paper.

2. Description of the Prior Art

When images are to be formed on OHP paper by electrophotographic image forming apparatus, the transfer output and fixing speed for forming images on plain paper must be altered in view of the difference between the OHP paper and the plain paper in properties.

Accordingly, image forming apparatus are already available wherein OHP paper is supplied to the main body thereof only through a manual feed portion and which are adapted to alter the transfer output, etc. when an OHP paper sensor provided for the manual feed portion detects OHP paper by checking whether light passes through the copy paper manually fed.

However, the image forming apparatus has the drawback that the operator must feed OHP paper one sheet after another when many copies of OHP paper are to be made since the OHP paper is not feedable to the apparatus body from a paper cassette.

The above drawback can be overcome by providing another OHP paper sensor, like the one mentioned, at a suitable portion of the path of transport of the copy paper to be fed from the paper cassette so that the OHP paper can be fed not only from the manual feed portion but also from the cassette.

Nevertheless, another problem will then be encountered. Since OHP paper sensors of the transmission type are expensive, use of the two OHP paper sensors makes the image forming apparatus more costly.

SUMMARY OF THE INVENTION

The main object of the present invention is to provide an inexpensive image forming apparatus wherein not only plain paper but also OHP paper is usable as copy paper.

Another object of the present invention is to provide an image forming apparatus which includes no OHP paper sensor and which is nonetheless adapted for use with OHP paper serving as copy paper.

These objects of the present invention are fulfilled by providing an image forming apparatus which has:

- a transfer drum having chuck means thereon for chucking copy paper fed to the main body of the apparatus to transfer an electrostatic latent image formed on the surface of a photosensitive member onto the copy paper held on the transfer drum by the chuck means,
- a sensor disposed forwardly of a chucking position where the copy paper is held on the transfer drum by the chuck means with respect to the direction of rotation of the transfer drum, the sensor having a light emitting element disposed inside the transfer drum and a photodetector disposed outside the transfer drum so as to be opposed to the light emitting element,
- a first detecting position provided in the vicinity of the chuck means on the transfer drum and permitting light emanating from the light emitting element to pass through the transfer drum at the first detecting position and to be detected by the photodetector,
- a second detecting position provided rearwardly of the first detecting position on the transfer drum with respect to the direction of rotation of the transfer drum and permitting light emanating from the light emitting element to pass through the transfer drum at the second detecting position and to be detected by the photodetector, and
- control means for controlling the sensor so that the sensor operates when the first detecting position and the second detecting position on the transfer drum move past the sensor These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DESCRIPTION OF THE PREFERRED EMBODIMENT

Figure 1:
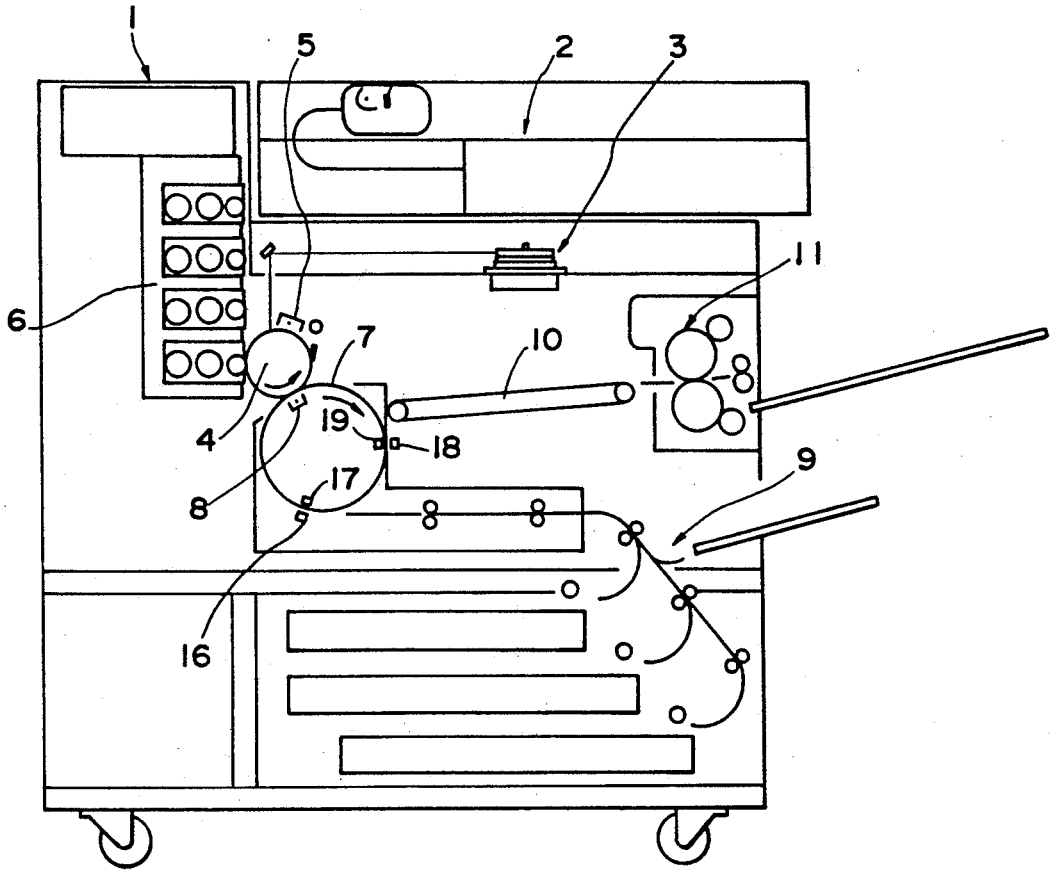
FIG. 1 is a diagram schematically showing the overall construction of an image forming apparatus embodying the invention.

FIG. 1 shows an electrophotographic multicolor copying apparatus 1 having a transfer drum 7. As is well known, the apparatus 1 comprises an image reader 2, exposure unit 3, photosensitive member 4, sensitizing charger 5, developing unit 6, transfer drum 7, transfer charger 8, paper feeder 9, conveyor belt 10, fixing unit 11, etc.

The image reader 2 comprises a reading device for reading the image of a document placed thereabove with a reading optical system through blue, green and red filters to produce three image data signals.

The photosensitive member 4 is uniformly charged by the charger 5 and forms an electrostatic latent image when exposed by the exposure unit 3 to a laser beam modulated in accordance with each of the image data signals delivered from the image reader 2.

The electrostatic latent image formed on the photosensitive member 4 is developed by the developing unit 6 with a selected developing device having a toner corresponding to the exposure light in color, whereby the latent image is converted to a visible toner image.

The toner image formed on the photosensitive member 4 is transferred by the transfer charger 8 onto copy paper sent forward by the paper feeder 9 and wound around the transfer drum 7. A full-color toner image developed with toners of three to four colors is eventually formed on the copy paper. The copy paper is thereafter separated from the transfer drum 7 and transported to the fixing unit 11 by the conveyor belt 10 for fixing the color image to the paper, whereupon the copy paper is discharged from the apparatus.

Figure 3:
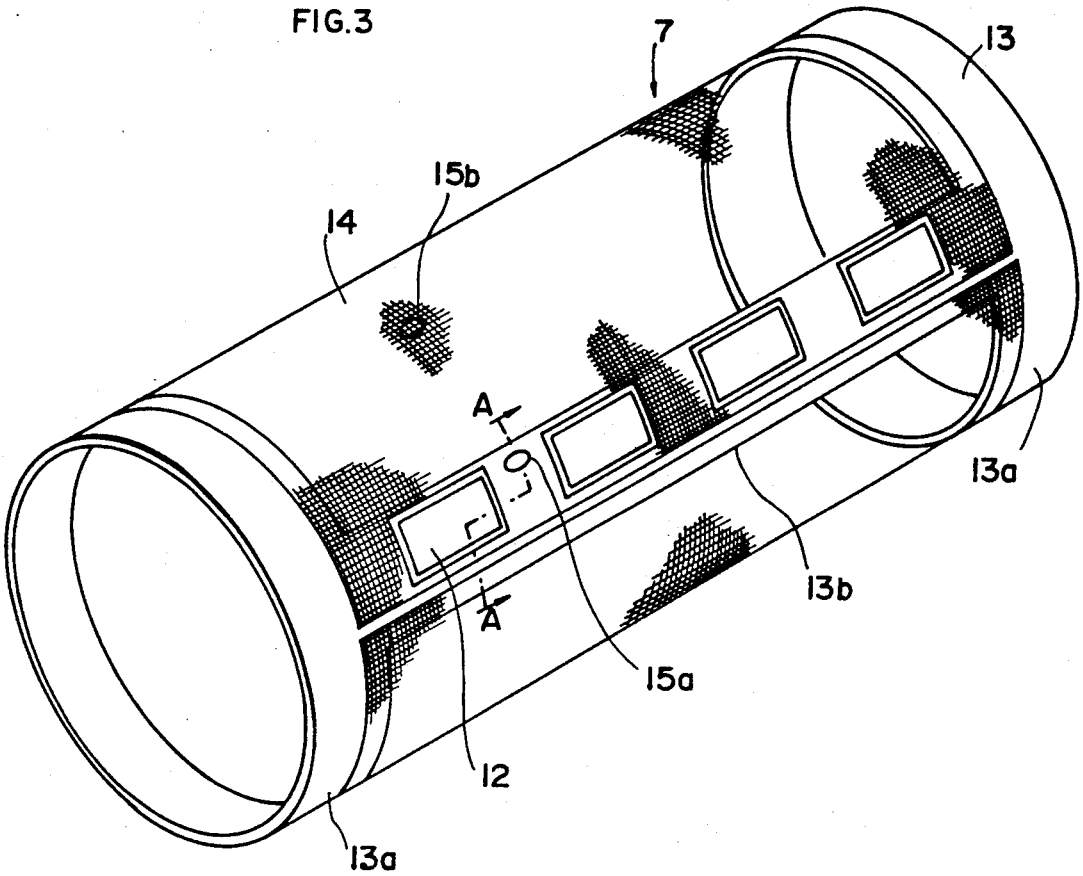
FIG. 3 is a perspective view of a transfer drum.
Figure 4:
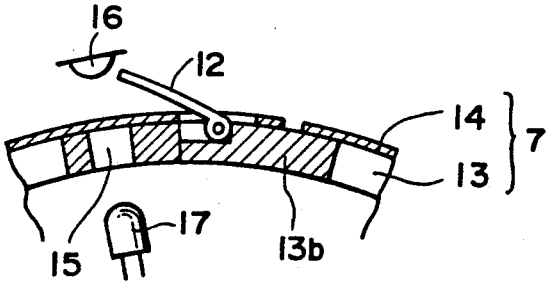
FIG. 4 is an enlarged view in section taken along the line A—A in FIG. 3.

The copying apparatus of such construction requires the step of winding copy paper around the transfer drum 7. The transfer drum 7 is therefore provided with a plurality of chuck means 12 arranged axially thereof as seen in FIGS. 3 and 4. The transfer drum 7 comprises a cagelike strength member 13 having annular portions 13*a* at its respective ends and a connecting member 13*b* interconnecting the annular portions 13*a*, and a transfer film 14 (illustrated as netting) wound around the strength member 13. The chuck means 12 are arranged on the connecting portion 13*b*. A detection aperture 15 for detecting mischucking of copy paper is formed in the connecting portion 13*b* in the vicinity of the chucking means 12.

As shown in FIG. 1, a sensor 16 for detecting mischucking is disposed at a position a small distance forwardly away, with respect to the direction of rotation of the drum 7, from the position where the copy paper supplied by the paper feeder 9 is chucked by the chuck means 12 on the drum 7. The sensor 16 comprises a photodetector and is adapted to detect light impinging thereon and emanating from a light emitting element 17 disposed inside the transfer drum 7 so as to be opposed to the sensor 16.

Figure 5:
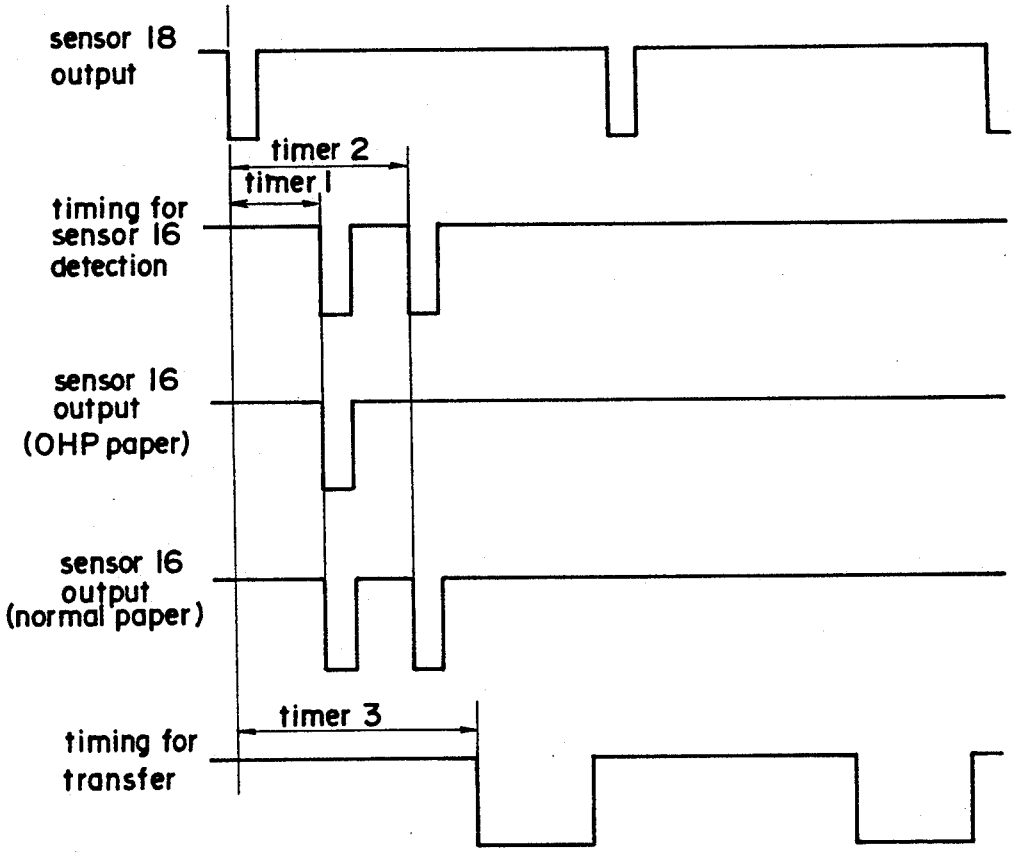
FIG. 5 is a timing chart showing the operation of a sensor.

Rearwardly of the chucking position with respect to the direction of rotation of the transfer drum 7, a reference position sensor 18 is provided for detecting a reference position for the rotation of the transfer drum 7 to operate the sensor 16, etc. with proper timing. A light emitting element 19 is disposed inside the drum 7 so as to be opposed to the sensor 18. With reference to FIG. 5, the output of the sensor 16 is read upon lapse of a period of time determined by a timer 1 and also a period of time determined by a timer 2 after the detection of the reference position by the sensor 18. A transfer operation is thereafter initiated at a time determined by a timer 3 based on the time of reference position detection.

The timers 1, 2 are so set that the sensor 16 is opposed to first and second detecting positions 15*a*, 15*b* (see FIGS. 2 and 3) on the transfer drum 7 and the copy paper wound therearound exactly upon the completion of their operation. The first detecting position 15*a* corresponds to the detection aperture 15. The second detecting position 15*b* is a suitable distance rearwardly away from the first detecting position 15*a* with respect to the direction of rotation of the drum 7. In the case where the connecting portion 13*b* is absent but the transfer film 14 only is present at the second detecting position 15*b*, there is no need to form a detection aperture at this position.

Figure 6:
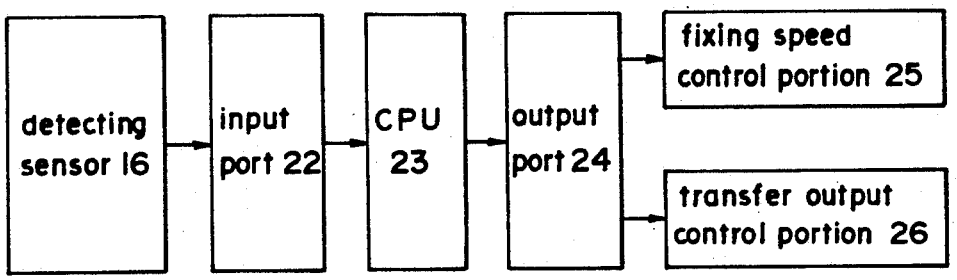
FIG. 6 is a control block diagram.

With reference to FIG. 6, the output signal of the sensor 16 is fed via an input port 22 to a CPU 23 for controlling the copying apparatus 1. The CPU 23 delivers control output signals to a fixing speed controller 25 and a transfer output controller 26 via an output port 24.

Figure 2:
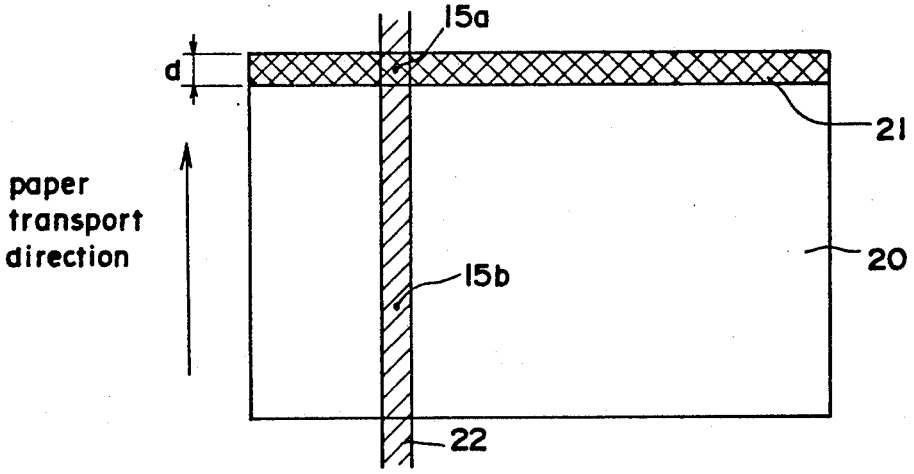
FIG. 2 is a diagram for illustrating detecting positions on OHP paper.

Referring to FIG. 2, OHP paper is provided at its leading end with a nontransparent portion 21 having a predetermined width d (which is about 6 mm to be suitable) for the detection of mischucking. Indicated at 22 in FIG. 2 is the path of movement of the sensor 16 relative to the paper.

The operation of the sensor 16 included in the foregoing arrangement will be described chiefly with reference to FIGS. 1 to 5.

Copy paper is fed by the paper feeder 9 to the transfer drum 7 as timed with the chucking means 12 and chucked by these means 12 at the chucking position. The first detecting position 15*a* in the vicinity of the chuck means 12 is thereafter brought into opposed relation with the sensor 16, whereupon the timer 1 completes its operation to turn on the light emitting element 17, permitting the sensor 16 to detect the light from the light emitting element 17. However, in the case where the copy paper has been properly chucked, the light can not be detected by the sensor 16 because the light is of course blocked by the copy paper if it is plain paper or by the nontransparent portion 21 of the copy paper if it is OHP paper. Thus, the failure for the sensor 16 to detect the light indicates that the copy paper is properly held on the drum 7 by the chuck means, so that the copying operation is continued. If the copy paper has not been chucked properly, the light from the light emitting element 17 is not blocked by the copy paper but impinges on the sensor 16, which in turn detects the light. The detection of the light by the sensor 16 is therefore interpreted as indicating that the copy paper is not properly chucked, followed by an interruption of the copying operation.

When the copy paper is properly chucked, the second detecting position 15*b* is thereafter opposed to the sensor 16, whereupon the timer 2 completes its operation to turn on the light emitting element 17 for the operation of the sensor 16. In the case where the copy paper is OHP paper 20 which passes light therethrough, the sensor 16 detects the light, whereas if it is plain paper, the light is blocked by the paper and can not be detected by the sensor 16. Based on the result of detection, the CPU 23 recognizes whether the copy paper is OHP paper or plain paper. When the copy paper is found to be plain paper, the copying operation is further continued under the usual conditions. If it is OHP paper, the conditions to be provided by the fixing speed controller 25 and the transfer output controller 26 are altered for a further copying operation. Subsequently, the timer 3 completes its operation, followed by a transfer operation.

In this way, the single sensor 16 is operable for detecting mischucking of the copy paper and for detecting whether the copy paper is plain paper or OHP paper.

Though the sensor 16 used in the embodiment is a light transmittance type, any type of sensor, for example, a light reflection type of sensor may be used if it detects mischucking of the copy paper at a first detecting position on the transfer drum and detects whether the copy paper is plain paper or OHP paper at a second detecting position on the transfer drum.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a rotatable transfer drum having chucking means on the surface thereof for chucking a transfer paper on the transfer surface at a chucking position;

a sensor whose change in state is detected provided in the vicinity of the transfer drum; and control means for controlling the sensor to operate when first and second detecting positions on the transfer drum pass the sensor, said first detecting position being in proximity to the chucking means and said second detecting position being spaced from the first detecting position.

2. An image forming apparatus as claimed in claim 1 wherein the sensor is provided downstream of the chucking position with respect to the direction of the transfer drum rotation.

3. An image forming apparatus as claimed in claim 1 wherein the sensor includes a light emitting element opposite to a light receiving element through the transfer drum for detecting the light penetrating the transfer drum.

4. An image forming apparatus as claimed in claim 1 wherein a first hole is formed at the first detecting position on the transfer drum surface, so that the light from the light emitting element reaches the light receiving element through said first hole only when the transfer paper is not chucked properly by the chucking means.

5. An image forming apparatus as claimed in claim 4 wherein a second hole is formed at the second detecting position on the transfer drum, so that the light from the light emitting element reaches the light receiving element through said second hold when a transparent transfer paper is chucked on the transfer drum.

6. An image forming apparatus as claimed in claim 5 wherein the transparent transfer paper is chucked at an opaque portion thereof by the chucking means, so that the light from the light emitting element reaches the light receiving element through the first hold only when the transparent transfer paper is not chucked properly by the chucking means.

7. An image forming apparatus comprising:

a rotatable transfer drum;

chucking means arranged on the transfer drum surface for chucking a transfer paper on the transfer drum surface at a chucking position;

detecting means provided in the vicinity of the transfer drum for detecting light passing through the transfer drum;

a first detecting position on the transfer drum surface which is in proximity to the chucking means;

a second detecting position on the transfer drum surface which is spaced from said first detecting position; and determining means for determining that the transfer paper is not properly chucked by the chucking means when the detecting means detects the light passing through the transfer drum at the first detecting position and that the transfer paper is transparent when the detecting means detects the light passing through the transfer drum at the second position.

8. An image forming apparatus as claimed in claim 7 wherein the sensor is provided downstream of the chucking position with respect to a direction of the transfer drum rotation.

9. An image forming apparatus as claimed in claim 7 wherein the transfer paper determined to be transparent is chucked on the transfer drum at an opaque portion thereof by the chucking means.

10. A method performed in an image forming apparatus comprising a rotatable transfer drum for transferring a developed image to a transfer paper thereon, chucking means provided at the transfer drum for chucking the transfer paper on the transfer drum at a chucking position and a sensor provided in the vicinity of the transfer drum for detecting light passing through the transfer drum at a first position, said method comprising the steps of:

chucking the transfer paper on the transfer drum by the chucking means;

determining that the transfer paper is not properly chucked on the transfer drum based on the detection of first light by the sensor, said first light passing through the transfer drum in proximity to the chucking means;

determining that the transfer paper is transparent based on the detection of second light by the sensor, said second light passing through the transfer drum at a position different from the first position.

11. An image forming apparatus comprising:

a rotatable transfer drum having chucking means on the surface thereof for chucking a transfer paper on the transfer surface at a chucking position;

detecting means provided in the vicinity of the transfer drum for detecting light passing through the transfer drum;

a first detecting position on the transfer drum surface which is in proximity to the chucking means;

a second detecting position on the transfer drum surface which is spaced from said first detecting position; and determining means for determining whether or not the transfer paper on the surface of the transfer drum is transparent in accordance with the state of said detecting means at said first and second detecting positions.

* * * * *

UNITED STATES PATENT AND TRADEMARK OFFICE

CERTIFICATE OF CORRECTION

PATENT NO. : 5,185,633

DATED : February 9, 1993

INVENTOR(S) : Naotoshi Kawai, et al.

It is certified that error appears in the above-identified patent and that said Letters Patent is hereby corrected as shown below:

In Col. 5, line 28 (Claim 5, line 5), change "hold" to --hole--.

In Col. 5, line 34 (Claim 6, line 5), change "hold" to --hole--.

In Col. 6, line 29 (Claim 10, line 16), after "means;", insert --and--.

Signed and Sealed this

Seventh Day of December, 1993

Bruce Lehman

*Attest:*

BRUCE LEHMAN

*Attesting Officer*

*Commissioner of Patents and Trademarks*